United States Patent [19]

Stidwell

[11] Patent Number: 4,710,736

[45] Date of Patent: Dec. 1, 1987

[54] FLEXIBLE WAVEGUIDES WITH 45° CORRUGATIONS TO ALLOW BENDING AND TWISTING OF WAVEGUIDES

[76] Inventor: Alan G. Stidwell, Higher Lake Farm, Woodland, Ashburton, TO13 7LL, Devon, United Kingdom

[21] Appl. No.: 708,954

[22] PCT Filed: Jul. 5, 1984

[86] PCT No.: PCT/GB84/00241

§ 371 Date: Mar. 4, 1985

§ 102(e) Date: Mar. 4, 1985

[87] PCT Pub. No.: WO85/00471

PCT Pub. Date: Jan. 31, 1985

[30] Foreign Application Priority Data

Jul. 5, 1983 [GB] United Kingdom ..... 8318144

[51] Int. Cl.[4] ..... H01P 3/14

[52] U.S. Cl. ..... 333/241; 333/242; 138/121; 138/122

[58] Field of Search ..... 333/241, 242, 239; 138/121, 122, DIG. 8

[56] References Cited

U.S. PATENT DOCUMENTS

| | | | |
|---|---|---|---|
| 3,090,019 | 5/1963 | Johnson et al. | 333/241 |
| 3,201,723 | 8/1965 | Martin et al. | 333/241 |
| 3,315,185 | 4/1967 | Muller | 333/241 |
| 3,331,400 | 7/1967 | Vilkaitis | 333/241 X |
| 3,345,590 | 10/1967 | Wolfgang et al. | 333/239 |
| 3,372,352 | 3/1968 | Krank et al. | 333/241 |
| 3,938,244 | 2/1976 | Merle | 333/241 X |
| 4,144,510 | 3/1979 | Brown et al. | 333/241 |

FOREIGN PATENT DOCUMENTS

| | | | |
|---|---|---|---|
| 2528240 | 12/1983 | France | 333/241 |
| 916152 | 1/1963 | United Kingdom | 333/241 |

*Primary Examiner*—Eugene R. LaRoche
*Assistant Examiner*—Benny Lee
*Attorney, Agent, or Firm*—Thomas J. Greer, Jr.

[57] ABSTRACT

A flexible waveguide (1) has corrugated seamless walls (2) the corrugations of which are inclined to the transverse planes of the waveguide, that is, planes perpendicular to the longitudinal axis of the waveguide, at an angle of substantially 45°. The inclined corrugations, which may be annular or helical, permit both flexing and twisting of the waveguide.

9 Claims, 6 Drawing Figures

FLEXIBLE WAVEGUIDES WITH 45° CORRUGATIONS TO ALLOW BENDING AND TWISTING OF WAVEGUIDES

This invention relates to flexible waveguides.

PRIOR ART

A known construction of flexible waveguide has walls which have a corrugated or bellows-like conformation, the corrugations lying in planes transverse to the longitudinal axis of the waveguide. The corrugations may be formed by winding a conductive metal strip such as brass and sealing adjacent windings together by solder. Such a waveguide is flexible by virtue of the flexibility of the strip forming the individual corrugations, but is not in general capable of being twisted. In order to sustain an angular deformation or twist about its longitudinal axis a corrugated waveguide has to be formed with interlocking corrugations which overlap, for example, around a wire core which is wrapped around the waveguide; sliding movement of the individual corrugations or "turns" relative to the wire core permits a degree of twist in the waveguide.

BRIEF SUMMARY OF THE INVENTION

The present invention seeks to provide, in a simple construction, a corrugated waveguide which is capable of sustaining both bending and twisting movements.

According to the invention there is provided a flexible waveguide having corrugated walls the corrugations of which are inclined to the transverse planes of the waveguide, that is, planes perpendicular to the longitudinal axis of the waveguide at an angle of substantially 45°. Such a corrugation angle has been found in practice to permit combined bending and twisting of the waveguide.

Upon flexing of the waveguide according to the invention the waveguide can exhibit both bending and twisting deformation. Such deformation can be useful for certain interfacing applications. In some cases the degree of twist imparted to a length of the flexible waveguide will be a result of a bending of the waveguide and will depend on the exact angle of the inclined corrugations, the length of the waveguide and the degree of bending imparted thereto. In other cases, bending and twisting deformations of the waveguide will be independent of each other.

The corrugations in the waveguide may be rectangular in cross sectional profile. Alternatively the corrugations may have a substantially sinusoidal cross sectional profile, applicable more particularly to the larger sizes of waveguide.

The waveguide according to the invention is preferably seamless. The corrugations may be obtained by, for example, an hydraulic cold-forming process or an electro-forming process.

The seamless flexible waveguide according to preferred embodiments of the invention, in contrast with previously known twistable waveguides, does not have any discontinuity between adjacent corrugations, for permitting relative sliding movement between these corrugations. Since the corrugations are formed in a single piece of sheet metal without discontinuity the degree of radio frequency leakage exhibited by the flexible waveguide according to the invention is potentially less than that exhibited by flexible waveguides of the traditional construction referred to previously.

BRIEF DESCRIPTIONS OF THE DRAWINGS

The invention will be further described, by way of example only, with reference to the accompanying purely diagrammatic drawings, in which:

FIGS. 1 to 4 are respective plan views of sections of flexible waveguide according to four different embodiments of the invention, FIG. 5 is a perspective view of part of the flexible waveguide illustrated in FIG. 3 with annular corrugations, illustrating its flexing and twisting characteristics, and FIG. 6 is a perspective view of part of the flexible waveguide illustrated FIG. 3 with multi-start helical corrugations, showing its flexing and twisting.

DETAILED DESCRIPTION

FIGS. 1 to 4 illustrate sections of flexible waveguide 1 the walls of which are continuous, that is, seamless, and formed with corrugations 2 which are inclined at an angle $\alpha$ of substantially 45° to the longitudinal axis of the waveguide 1. In other words, the corrugations 2 are inclined at 45° to the transverse planes in which the corrugations of a conventional flexible waveguide would normally lie.

Figure 1:
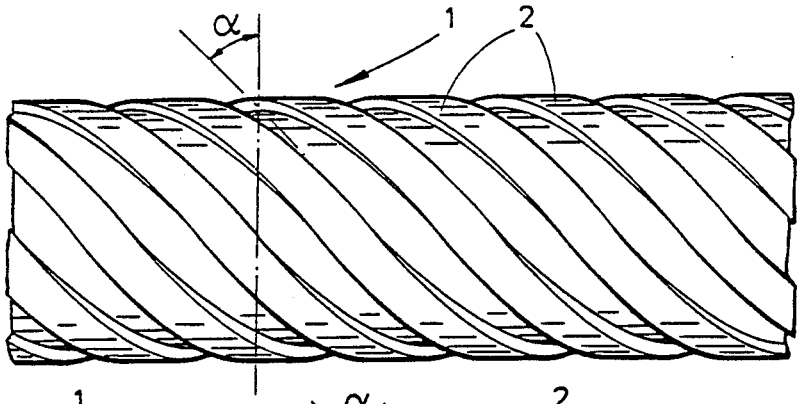
Figure 2:
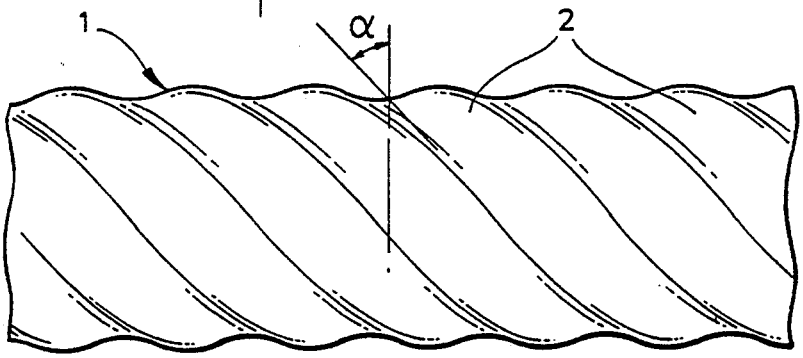

The corrugations 2 in the waveguide are preferably of helical or spiral configuration, as illustrated diagrammatically in FIGS. 1 and 2 respectively, with a pitch angle $\alpha$ of 45°. Alternatively, the corrugations 2 may be fully annular, as illustrated in FIGS. 3 and 4. where the corrugations 2 are of helical form, the requisite corrugation pitch is achieved by conforming the corrugations to a multi-start helical configuration.

Figure 3:
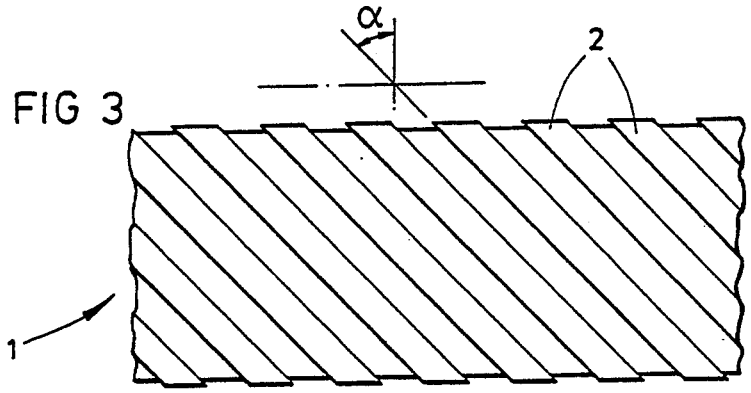

The individual corrugations, whether of spiral or annular form, may have a rectangular profile, as illustrated in FIGS. 1 and 3. Such corrugations are particularly applicable to the smaller sizes of waveguide down to millimetric sizes and are readily formed by electroforming techniques, that is, by electrolytic deposition of the waveguide upon a former or arbor, which is subsequently dissolved.

Figure 4:
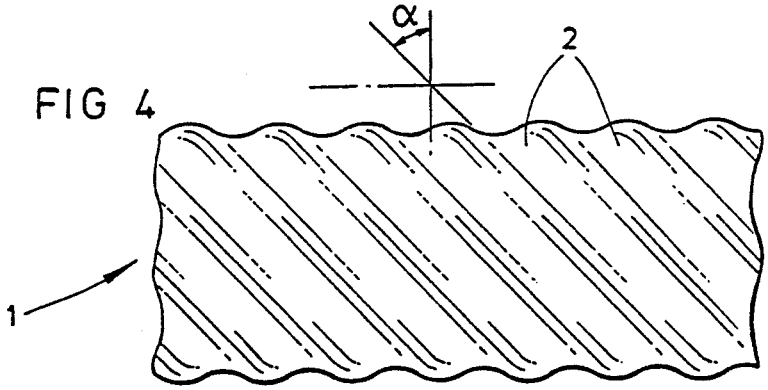

The corrugations 2 of the waveguide may alternatively have a generally curved cross sectional profile, for example the sinusoidal profile illustrated diagrammatically in FIGS. 2 and 4. Corrugations of this profile are readily formed by hydraulic deformation of an initially smooth wall waveguide to conform to a profile determined by an external die or mould, the waveguide walls being deformed by the application of an internal hydraulic pressure. Corrugations of this profile are suitable for waveguides of larger sizes up to 26 GHz.

It will be understood that in practice the electroforming process may also be used for the production of waveguides of the kind illustrated in FIGS. 2 and 4, and the hydraulic forming method may be used for waveguides of the kind illustrated in FIGS. 1 and 3.

Figure 5:
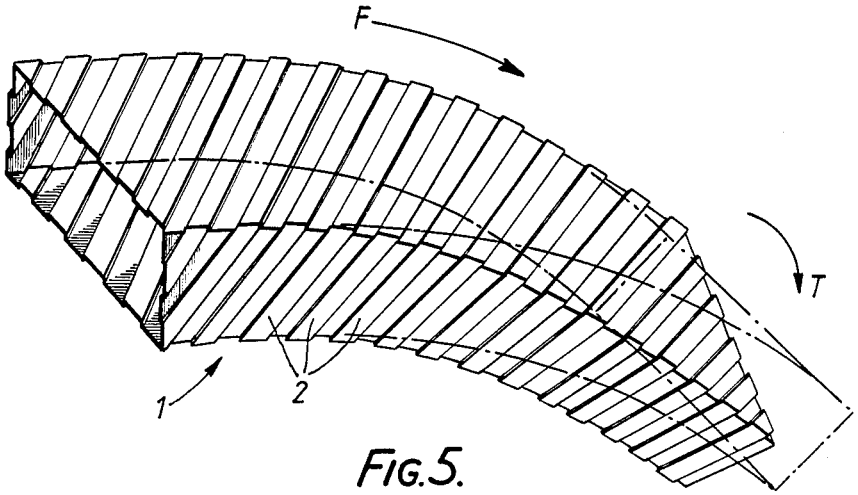
Figure 6:
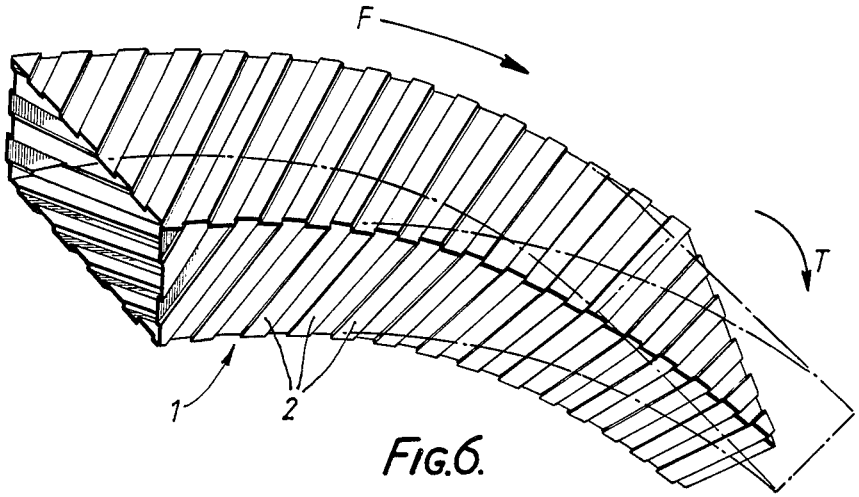

The inclined corrugations 2 of the flexible waveguide according to the invention permit flexing and twisting deformation of a section of waveguide, as illustrated schematically in FIG. 5 and FIG. 6. The inclined corrugations allow normal flexing of the waveguide perpendicular to its major face, as indicated in broken outline in FIG. 5 and FIG. 6, and also a twisting deformation of the waveguide, as shown in full outline the waveguide shown in FIG. 5 has annular corrugations of rectangular profile inclined to the longitudinal direction of the waveguide, whereas the waveguide shown in FIG. 6 has multi-start helical corrugations of rectangular profile.

In the illustrated embodiment, the flexing of the sections of waveguide 1 and 11 is indicated by the arrow F and is accompanied by a twisting deformation indicated by the arrow T. It will be seen that as a result of the bending and twisting of the waveguide the opposite ends of the flexed section of waveguide, as well as lying in different planes as a result of the bending of the waveguide, are also angularly displaced relative to each other about the longitudinal axis of the waveguide.

The degree of twisting may be predetermined, for a given length of waveguide, by the degree of bending imparted to the waveguide, or may be completely independent of the flexing of the waveguide.

The invention has been described in its particular application to flexible waveguides of rectangular cross section; it will be understood, however, that the invention is also applicable to flexible waveguides of circular and other cross-sectional profiles.

What is claimed is:

1. A waveguide capable of being bent and twisted through substantial angles, and formed of discontinuity-free metal tubing with continuous corrugations of the wall of the waveguide extending all around the waveguide at an angle of substantially 45° to the longitudinal direction of the waveguide.

2. A flexible waveguide according to claim 1, characterised in that the corrugations have a rectangular transverse profile.

3. A flexible waveguide according to claim 1, characterised in that the corrugations have a substantially sinusoidal transverse profile.

4. A waveguide according to claim 1 having substantially circular cross-section wherein the corrugations are continuous multi-start interwound helical corrugations at an angle of substantially 45° to the longitudinal direction of the waveguide.

5. A waveguide according to claim 1 having substantially rectangular cross-section wherein the corrugations are continuous multi-start interwound helical corrugations at an angle of substantially 45° to the longitudinal direction of the waveguide.

6. A waveguide according to claim 1 having substantially rectangular cross-section wherein the corrugations are oblique continuous annular corrugations in which the individual corrugations on each wall of the waveguide are at an angle of substantially 45° to the longitudinal direction of the waveguide.

7. A waveguide capable of being bent and twisted through substantial angles and consisting of seamless metal tubing with continuous multi-start interwound helical corrugations at an angle of substantially 45° to the longitudinal direction of the waveguide.

8. A flexible waveguide according to claim 7, characterised in that the corrugations have a rectangular transverse profile.

9. A flexible waveguide according to claim 7, characterised in that the corrugations have a substantially sinusoidal transverse profile.

* * * * *